United States Patent [19]

Hayashi et al.

[11] 4,217,674

[45] Aug. 19, 1980

[54] UPRIGHT VACUUM CLEANER

[75] Inventors: Seizo Hayashi, Yohkaichi; Shinya Tsutsumi, Ohmi-hachiman; Yoshihiro Kuroki, Yohkaichi, all of Japan

[73] Assignee: Matsushita Electric Industrial Co., Ltd., Osaka, Japan

[21] Appl. No.: 965,495

[22] Filed: Dec. 1, 1978

[30] Foreign Application Priority Data

Dec. 6, 1977 [JP] Japan ..... 52-146744

[51] Int. Cl.[2] ..... A47L 5/34

[52] U.S. Cl. ..... 15/361

[58] Field of Search ..... 15/354, 355, 356, 359, 15/360, 361

[56] References Cited

U.S. PATENT DOCUMENTS

| | | | |
|---|---|---|---|
| 1,405,095 | 1/1922 | Brachhausen | 15/355 |
| 2,260,207 | 10/1941 | Berg | 15/361 X |
| 3,358,316 | 12/1967 | Okun | 15/354 X |
| 3,416,181 | 12/1968 | Nordeen | 15/359 |
| 3,676,892 | 7/1972 | Nordeen | 15/359 |
| 3,854,164 | 12/1974 | Schmitz | 15/340 |

FOREIGN PATENT DOCUMENTS

| | | | |
|---|---|---|---|
| 960816 | 1/1975 | Canada | 15/354 |

*Primary Examiner*—Christopher K. Moore
*Attorney, Agent, or Firm*—Joseph W. Farley

[57] ABSTRACT

An upright vacuum cleaner comprising a main body having a suction opening in the lower surface of its front portion and a handle body connected to a rear portion of the main body and extending upward. The main body is pivotally movable in the form of a seesaw as supported by contact portions on the main body positioned to the rear of the suction opening. The handle body is pivoted to the main body shiftably between an upright position and an inclined position and is provided on its lower end with propelling wheels which are positioned rearwardly away from a line perpendicular to a floor surface and passing through the pivot point. The main body front portion, namely the suction opening, is held raised from the floor surface while the handle body is in its upright position but comes into contact with the floor surface when the handle body is inclined through an angle suitable for use.

10 Claims, 5 Drawing Figures

UPRIGHT VACUUM CLEANER

The present invention relates to a vacuum cleaner, and more particularly to an upright vacuum cleaner including a main body having a suction opening in its lower surface and movable on a floor surface and a handle body extending upward from the main body.

Upright vacuum cleaners are frequently left in idle operation during use as when the user shifts an article of furniture. If the cleaner is allowed to stand in this state for a prolonged period of time, the electric fan will become overheated to produce thermal deformation in resin parts such as the main body since the suction opening is held closed with the surface to be cleaned such as floor surface or carpet thereon (hereinafter referred to simply as "floor surface"). Furthermore, a rotary brush and/or a beating element such as a beater, if provided at the suction opening, will then stroke or beat the same portion of the floor surface, causing damage to the floor surface as by picking loops or tufts from a carpet. If the rotary brush is used on a floor surface provided by polyester fibers or the like having low heat resistance, the rotation of the brush on the same portion produces frictional heat which would melt some fibers to lock the brush, possibly breaking the drive belt for the rotary brush.

To overcome these problems, upright vacuum cleaners have already been proposed which are so designed that when a handle body is raised to an upright position relative to the cleaner main body, namely to the floor surface, to interrupt the cleaning operation, the suction opening is automatically moved away from the floor surface in operative relation to the movement of the handle body, as disclosed, for example, in U.S. Pat. Nos. 3,676,892 and 3,854,164. Like the conventional cleaner to be described later with reference to FIG. 5, such cleaners nevertheless have a complex construction including a lever mechanism and require many steps of assembling a large number of parts, so that they are costly to make and involve difficulties in ensuring a stable operation over a prolonged period of time.

The main object of this invention is to provide an upright vacuum cleaner which has a simple construction with a reduced likelihood of troubles and in which a suction opening is automatically movable away from the floor surface when a handle body is raised to an upright position relative to the floor surface so that the suction opening will not be closed for a long time, the suction opening portion further being automatically movable away from the floor surface together with a rotary brush or a beating element for the floor surface when provided with the brush or the element, for the protection of the floor surface.

To fulfil this object, the present invention provides an upright vacuum cleaner comprising a main body having a suction opening in the lower surface of its one end and contact portions adapted for contact with a floor surface and positioned on one side of the suction opening remote from said one end, the main body being pivotally movable on the contact portions, and a handle body including a lower end portion pivoted to the other end of the main body turnably about a horizontal axis. The handle body is therefore movable between an upright first position and a second position in which the handle body is inclined at a desired angle. Propelling wheels mounted on the lower end portion of the handle body are positioned away from a line perpendicular to the floor surface and passing through the horizontal axis when the handle body is in its upright position.

According to an embodiment of this invention, the contact portions are front wheels mounted on the main body. This renders the main body smoothly movable and eliminates the wear on the contact portions.

Further according to a preferred embodiment of this invention, the suction opening is provided with auxiliary means such as a rotary brush, or a beater or like impact imparting element for releasing dust from the floor surface.

The auxiliary means can be driven by the rotary shaft of an electric fan housed in the handle body coaxially with the horizontal axis, the rotary shaft extending through the handle body into the main body. Notwithstanding that the handle main body houses a dust collector including the electric fan and a dust collecting bag, the auxiliary means within the main body can be driven by the same single motor as used for the fan.

Other features and advantages of this invention will be readily understood from the description given below with reference to the accompanying drawings, in which.

Figure 5:
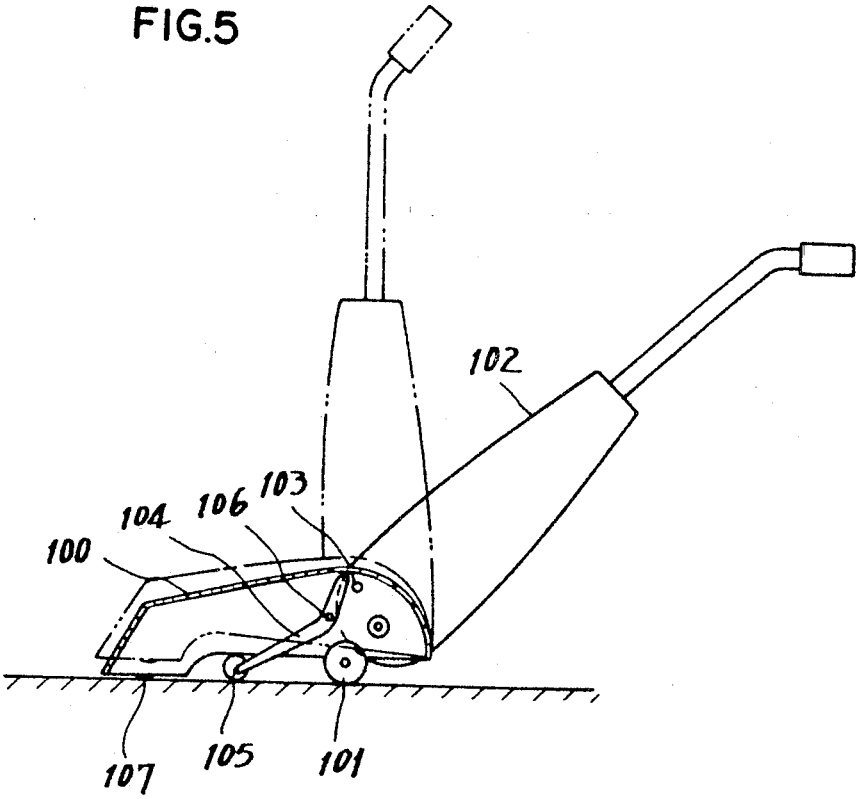
FIG. 5 is a diagram showing the construction of a conventional cleaner.

Before describing an embodiment of the present invention, the construction of a conventional vacuum cleaner referred to above will be described with reference to FIG. 5. While the cleaner is used in the usual position, the main body 100 is movable on the floor surface as supported by rear wheels 101 on the main body. The front lower surface of the main body 100 is in contact with the floor surface. A handle body 102 is pivoted to a rear portion of the main body 100. When cleaning, the user holds the handle body 102 in the inclined position indicated in the solid line and moves the main body 100. When the handle body 102 is brought to its upright position indicated in the phantom line for an interruption of the cleaning operation, a boss 103 on the handle body 102 comes into contact with a lever 104, depressing a front wheel 105 on the front end of the lever 104. Since the lever 104 is supported by a pin 106 on the main body 100, the resulting counteraction raises the front portion of the main body 100 after the front wheel 105 has been brought into contact with the floor surface, whereby the suction opening or rotary brush 107 is lifted from the floor surface. Thus the conventional cleaner has a complex construction which is liable to malfunction, for example, owing to the deformation of the lever.

This invention, which has overcome such a drawback, will be described with reference to the embodiment shown in FIGS. 1 to 4. The main body 1 of the cleaner is formed with a substantially rectangular suction opening 1*a* in the lower surface of its front portion and is movable on a floor surface, namely the surface to be cleaned. With the present embodiment, the suction opening 1*a* is provided with auxiliary means 2 for releasing dust from the floor surface. The illustrated auxiliary means 2 comprises a rotary brush 23 on one half of the peripheral surface of a rotary drum 22 and a beater 24 on the other half thereof, the drum 22 being fixedly mounted on a rotary shaft 21 rotatably supported on the main body 1. The brush 23 is composed of bristles set into the peripheral surface in two rows spaced apart from each other circumferentially of the drum 22 and extending obliquely with respect to the axis of the drum. The beater 24 includes two projections of triangular cross section similarly spaced apart and extending obliquely of the drum axis. The beater 24 gives impact to a carpet or the like to release dust therefrom, while the brush 23 removes dust from the floor surface. The dust is entrained in a stream of suction air. A handle body 3 comprises a box-shaped dust collector 6 positioned in its lower portion and housing an electric fan 4 and a dust bag 5 or the like and a rodlike handle 7 extending upward from the dust collector 6. The handle body 3 is supported, at a lower end portion, by pivots 8 on a rear portion of the main body 1 and is turnable about a horizontal axis.

When using the cleaner of the construction described above, the user holds the free end of the handle 7 and moves the main body 1 back and forth for cleaning, with the handle body 3 inclined rearward. After cleaning, the handle 7 is raised to bring the handle body 3 to a substantially vertical upright position. In this position the cleaner is stored or allowed to stand.

Figure 1:
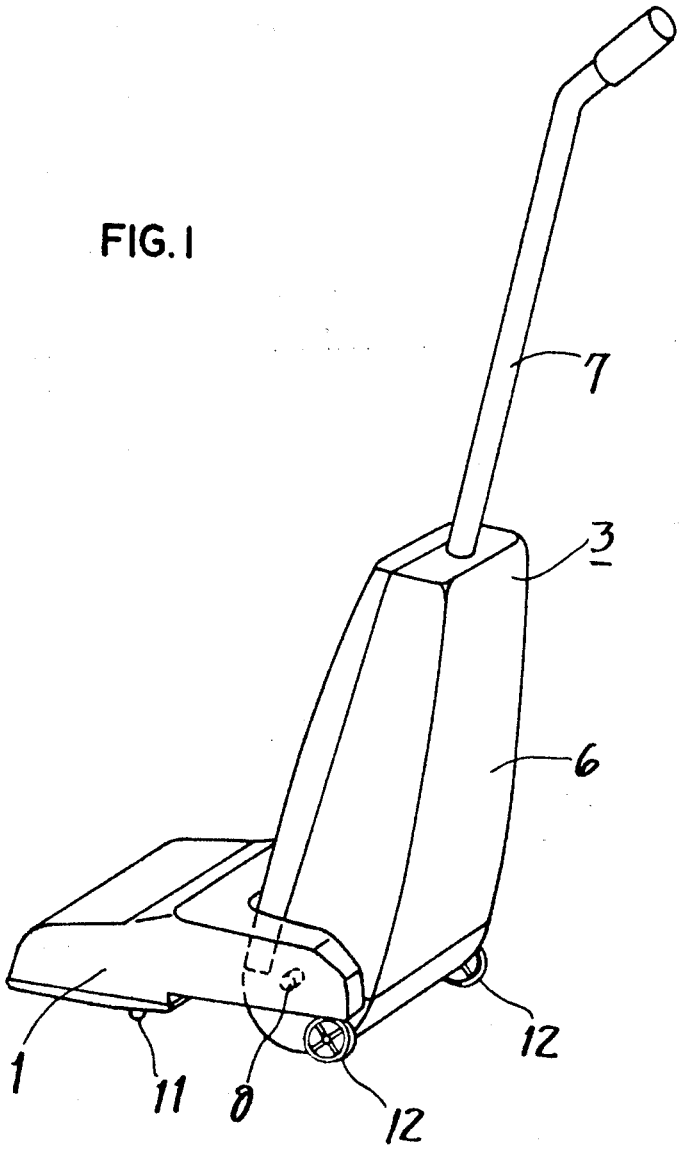
FIG. 1 is a perspective view showing a vacuum cleaner embodying the invention.
Figure 2:
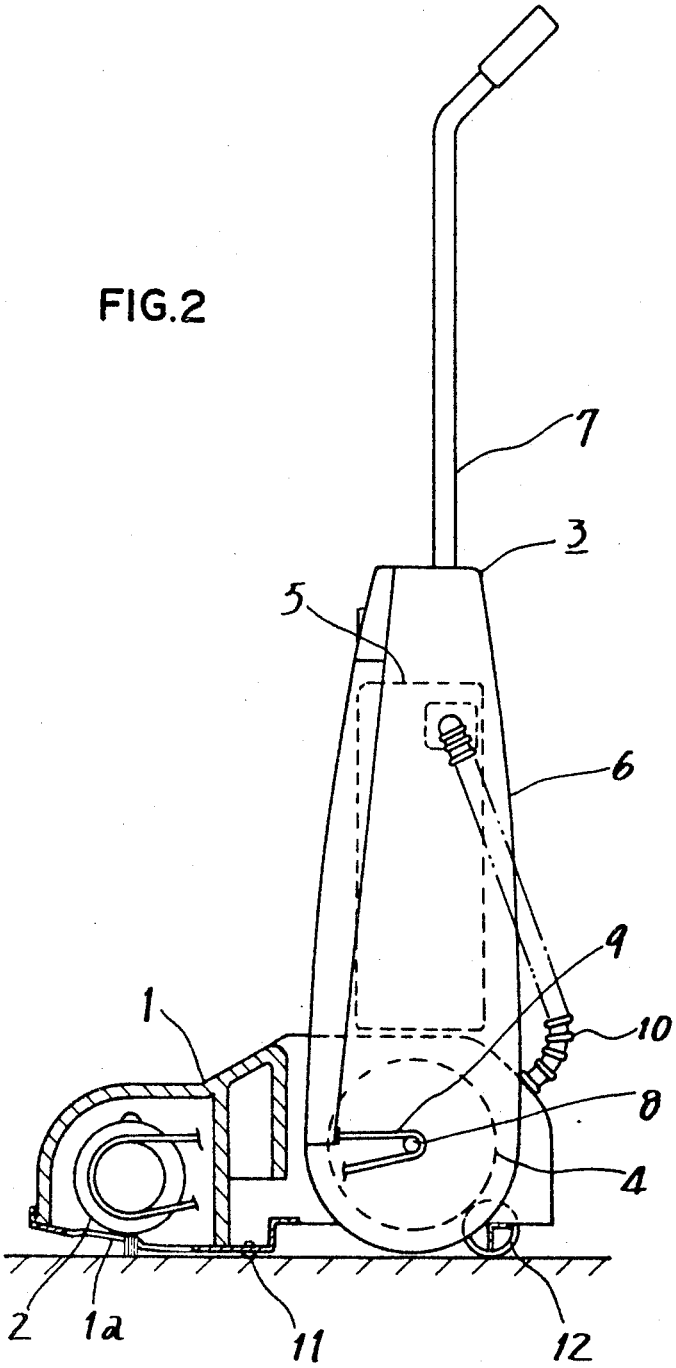
FIG. 2 is a side elevation partly broken away and showing the cleaner.
Figure 3:
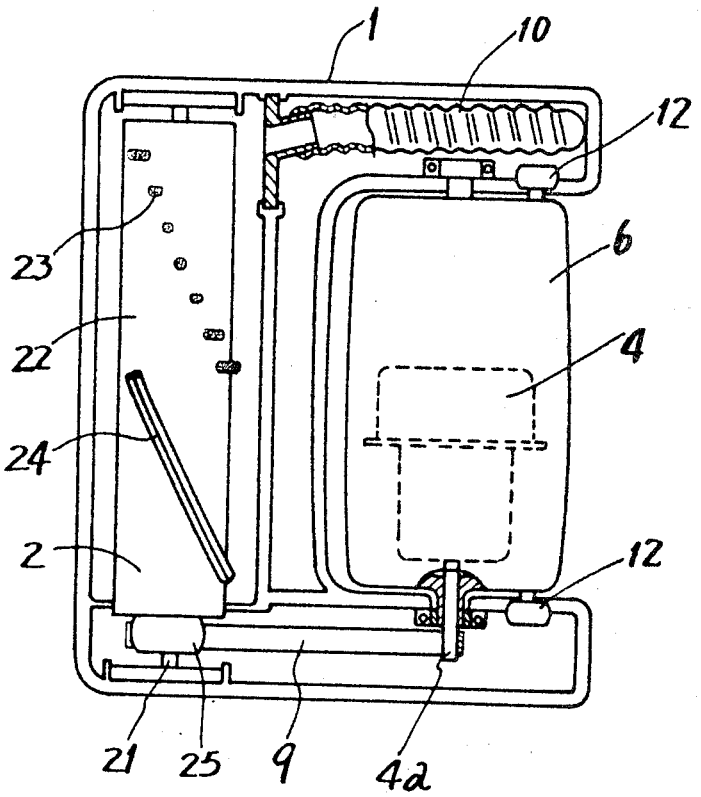
FIG. 3 is a bottom view partly broken away and showing the cleaner.

The electric fan 4 is arranged concentrically with the pivots 8 for supporting the handle body 3 on the main body 1. As seen in FIG. 3, the rotary shaft 4*a* of the fan 4 extends through the handle body 3, namely the pivot 8, into the main body 1. A belt 9 reeved around the fan shaft 4*a* and a pulley 25 on the rotary drum shaft 21 delivers the torque of the fan 4 to the drum 22. The dust released from the floor surface by the auxiliary means 2 and introduced into the main body 1 through the suction opening 1*a* as entrained in a suction air stream is conducted to the dust bag 5 of the dust collector 6 by way of a flexible hose 10. The hose 10 has one end in communication with the suction opening 1*a* via the interior space of the main body 1 accommodating the auxiliary means 2 and the other end communicating with the interior of the dust collector 6.

The dust is captured by the dust bag and separated from the air stream flowing through the opening 1*a* and hose 10, allowing clean air alone to flow out from the cleaner via an unillustrated outlet.

Indicated at 11 are front wheels mounted on the bottom of the main body 1 on the rear side of the suction opening 1*a*, and at 12 rear wheels mounted on a lower end portion of the handle body 3. The main body 1 is movable on the floor surface by these wheels 11 and 12. The front wheels 11 and the rear wheels 12 are so arranged as to fulfil the following positional and dimensional requirements.

The front wheels 11 are attached to the lowermost portion of the main body 1, such that the main body is pivotally movable upward or downward on the front wheels 11 like a seesaw. The position of the rear wheels 12 on the handle body 3 is so determined that when the handle body 3 is in its upright position substantially perpendicular to the floor surface, the pivots 8 are spaced from the floor surface by the shortest distance to position the rear portion of the main body 1 at a lower level, thus positioning the main body 1 in a rearwardly downwardly inclined posture, the position of the rear wheels 12 further being such that when the handle body 3 is inclined by the handle 7 through an angle generally suitable for use, the pivots 8 are at the largest distance from the floor surface so that the main body 1 is in a forwardly downwardly inclined position with the main body front portion at a lower level. Stated more precisely, the rear wheels 12 are positioned away from a line perpendicular to the floor surface and passing through the axis of the pivots 8 when the handle body 3 is in its upright position, whereas when the handle body 3 is in its inclined position for use, the rear wheels 12 are located close to a position immediately below the pivots 8, namely close to the perpendicular line. The rear wheels 12 mounted on the rear end portion of the handle body 3 must fulfil these requirements. The suction opening 1*a* of the main body 1 is adapted to be positioned close to the floor surface while the handle body 1 is in its inclined position for cleaning operation with the main body 1 in its forwardly downwardly inclined position so that all the dust on the floor can be removed.

Figure 4:
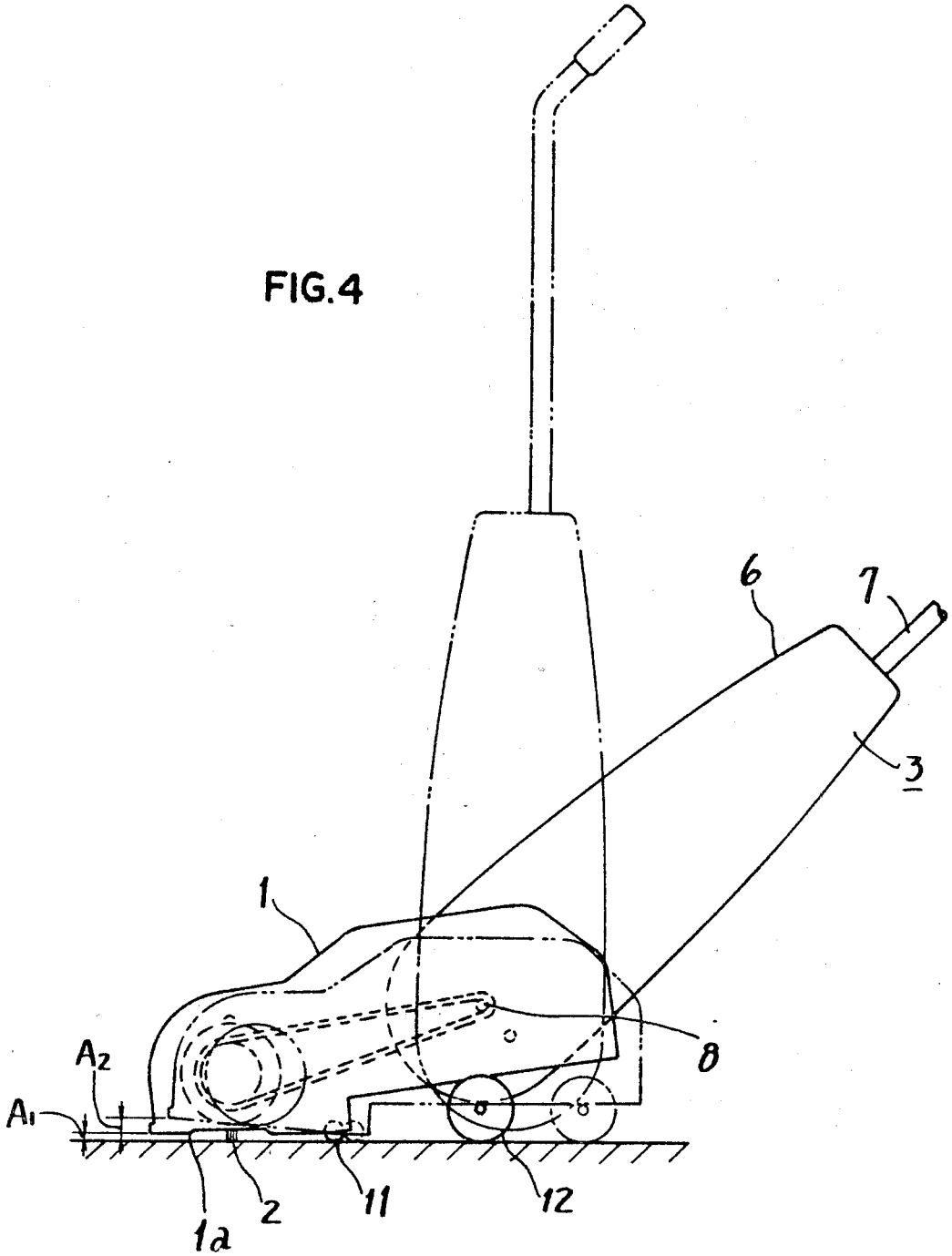
FIG. 4 is a diagram illustrating the cleaner in position for cleaning and also at rest during operation.

The cleaner of this invention will be used in the following mode as illustrated in FIG. 4. Since the handle body 3 is pivotally movable on the pivots 8 relative to the main body 1, the main body front portion is held in its lowered position by gravity as supported by the front wheels 11 on the floor surface during cleaning. The opening portion 1*a*, which is close to the floor surface as indicated at $A_1$ in FIG. 4 or in intimate contact therewith, assures a very efficient cleaning operation. The main body 1, being upwardly movable on the pivots 8, will have no difficulty in passing over a cigarette stub or like obstacle on the floor, if any. Thus a continuous cleaning operation can be carried out free of any trouble.

Not infrequently the user will interrupt the cleaning operation to arrange a table, chair or the like, to remove dust from furniture or to answer a telephone call, leaving the cleaner on the floor surface for idle operation. In such an event, the handle 7 is raised to bring the handle body 3 to its upright position indicated in the phantom line in FIG. 4. With this movement of the handle body 3, the rear wheels 12 turn from the position immediately below the pivots 8 rearward around the pivots 8, consequently lowering the level of the pivots 8 relative to the rear wheels 12 and reducing the distance between the pivots 8 and the floor surface since the rear wheels 12 are in contact with the floor surface at all times to support the cleaner. As a result, the main body 1, which is supported also by the front wheels 11, turns on the front wheels 11 to bring its rear portion to a lower level. The suction opening 1*a* and the auxiliary means 2 in the front portion of the main body 1 therefore rise from the floor surface as indicated at $A_2$.

With the main body thus positioned, the continued sucking action will not produce thermal deformation or like trouble that would occur when the suction opening is held closed for a prolonged period of time. Whereas the rotary brush, if allowed to rotate on the same portion of the surface to be cleaned (especially of carpet), will pick loops or tufts therefrom or otherwise damage the surface, such a trouble is avoidable. When a carpet of chemical fibers (especially of polyester, nylon or the like having low resistance to heat) is continuously brushed on the same portion, the resulting frictional heat is likely to melt some fibers which would in turn lock the brush, possibly breaking the drive belt for the brush, but such objection is similarly avoidable.

The cleaner of this invention is extremely simple in construction and includes none of sliding portions that would encounter increased resistance due to deposition of dust as is the case with usual cleaners. This ensures a trouble-free operation. Since there is no need to use a particular part of especially high strength, the cleaner can be fabricated with a stable quality.

Although the embodiment described above includes a rotary brush and a beater at the suction opening and incorporates suction means, the cleaner may be provided with the brush or beater only or with a suction opening having neither of these members. The suction means may be provided as a separate unit communicating with the suction opening through a hose. The beater can be of any other type. The front wheels mounted on the main body bottom of the embodiment may be replaced by some other members for supporting the main body and permitting inclination of the main body, such as contact members having, for example, a curved smooth surface.

With the rear wheels adapted to be positioned immediately below the pivots when the handle body is inclined at an angle appropriate to use, variations in the distance between the pivots and the floor surface can be minimized even if the angle of inclination alters to some extent owing to differences in the height of the users or to the movement of the hand holding the handle. This serves to maintain the suction opening portion in close proximity to or in contact with the floor surface as desired.

According to the invention described above, the suction opening portion can be brought into or out of contact with the floor surface by the turn of the handle without using any complex mechanism but with an extremely simple construction. The cleaner of this invention is therefore available at a reduced cost with a stable quality and is commercially very useful.

What is claimed is:

1. A vacuum cleaner including a main body having a suction opening in the lower surface of one end thereof, and a handle body including a lower end portion pivoted to the main body on a horizontal axis adjacent to the other end thereof, the handle body being movable about said axis between an upright storage position and an inclined operating position, wherein the improvement comprises:

contact portions carried by the main body, said contact portions being positioned between the suction opening and the pivotal axis of the handle body and being adapted for contact with a floor surface, the main body being rockable on the contact portions to vary the distance between the suction opening and the floor surface;

and supporting wheels rotatably mounted on the lower end portion of the handle body in radially spaced relation to the pivotal axis of the handle body, said wheels being movable with the handle body and being arranged to rock the main body on the contact portions and increase the distance between the suction opening and the floor surface in response to movement of the handle body to said upright storage position whereby the suction opening is moved away from the floor surface when the handle body is in said upright storage position and is moved toward the floor surface when the handle body is in said inclined operating position.

2. A vacuum cleaner as defined in claim 1 wherein the contact portions are wheels mounted on the main body.

3. A vacuum cleaner as defined in claim 1 wherein the suction opening is provided with auxiliary means for releasing dust from the floor surface.

4. A vacuum cleaner as defined in claim 3 wherein the auxiliary means is a beater.

5. A vacuum cleaner as defined in claim 3 wherein the auxiliary means is a rotary brush comprising bristles implanted in the peripheral surface of a rotary drum.

6. A vacuum cleaner as defined in claim 5 wherein an electric fan is housed in the handle body concentrically with the horizontal axis, and means is provided for coupling the rotary shaft of the fan with the rotary drum.

7. A vacuum cleaner as defined in claim 6 wherein the rotary shaft extends through the handle body into the main body in alignment with the horizontal axis, and the forward end of the shaft extension is coupled with the rotary shaft of the rotary drum by a belt.

8. A vacuum cleaner as defined in claim 1 wherein an electric fan is housed in the handle body concentrically with said horizontal axis, rotary auxiliary means is carried by the main body for releasing dust from the floor surface, and means is provided for coupling the rotary shaft of the fan with said rotary auxiliary means.

9. A vacuum cleaner as defined in claim 8 wherein the rotary shaft extends through the handle body into the main body in alignment with said horizontal axis and the outer end of the shaft is coupled with the rotary auxiliary means by a belt.

10. A vacuum cleaner as defined in claims 1, 8, or 9 wherein the handle body comprises a dust collector and a handle extending from the upper end of the dust collector and in the form of a rod, the dust collector incorporating therein a dust bag for collecting dust, the dust bag being in communication with the suction opening through a flexible tube.

* * * * *